US005866990A

United States Patent [19]

Ury et al.

[11] Patent Number: 5,866,990

[45] Date of Patent: *Feb. 2, 1999

[54] MICROWAVE LAMP WITH MULTI-PURPOSE ROTARY MOTOR

[75] Inventors: Michael G. Ury, Bethesda; Brian Turner, Myersville; Robert D. Wooten, Rockville, all of Md.

[73] Assignee: Fusion Lighting, Inc., Rockville, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 592,477

[22] Filed: Jan. 26, 1996

[51] Int. Cl.[6] ..... H05B 37/00

[52] U.S. Cl. ..... 315/248; 315/112

[58] Field of Search ..... 315/248, 85, 112, 315/117, 118, 119; 313/44, 146

[56] References Cited

U.S. PATENT DOCUMENTS

| | | | |
|---|---|---|---|
| 3,924,977 | 12/1975 | McCullough | 418/55 |
| 4,199,308 | 4/1980 | McCullough | 415/55 |
| 4,695,757 | 9/1987 | Ury et al. | 313/44 |
| 4,894,592 | 1/1990 | Ervin et al. | 315/248 |
| 5,461,636 | 10/1995 | Karube et al. | 372/58 |

FOREIGN PATENT DOCUMENTS

| | | |
|---|---|---|
| 57-55058 | 4/1982 | Japan . |

*Primary Examiner*—Don Wong
*Assistant Examiner*—David H. Vu
*Attorney, Agent, or Firm*—Pollock, Vande Sande & Priddy, R.L.L.P.

[57] ABSTRACT

In a microwave powered electrodeless lamp, a single rotary motor is used to a) rotate the bulb and b) provide rotary motion to a blower or pump means for providing cooling fluid to the magnetron and/or to a forced gas cooling for providing cooler gas to the bulb. The blower may consist of only of an impeller without the usual blower housing. The motor, bulb stem and bulb, or motor, bulb stem, bulb and blower may be formed as an integral unit so as to facilitate replacement.

21 Claims, 7 Drawing Sheets

MICROWAVE LAMP WITH MULTI-PURPOSE ROTARY MOTOR

This invention was made with Government support under Contract No. DE-FG01-95EE23796 awarded by the Department of Energy. The Government has certain rights in this invention.

BACKGROUND OF THE INVENTION

The present invention is directed to an improved microwave lamp, and particularly to such a lamp which is compact and has improved reliability.

Microwave lamps are well known, and typically include a means for providing microwave power, such as a magnetron, a bulb containing a discharge forming fill, and a means for coupling the microwave power to the bulb. Additionally, in many microwave lamps, the bulb is rotated. This is because bulb rotation affords numerous advantages, including temperature equalization around the bulb surface, improved spatial emission properties, discharge stabilization, elimination of visual "wobble", increased efficiency, and better cooling in those lamps where forced air cooling is applied to the bulb. For example, see U.S. Pat. Nos. 4,485,332, 4,695,757, 4,954,756, and U.S. Pat. No. 5,493,184, and co-pending U.S. application Ser. Nos. 08/811,466 and 08/811,467.

It is also a requirement in microwave lamps to provide cooling of the magnetron, and this is usually done by using a blower to provide forced air cooling. In the microwave lamps of the prior art, separate motors are used to rotate the bulb and to operate the blower.

As mentioned above, in some microwave lamps, notably those which operate at high power density, the bulb is also cooled by forced air. In such lamps, a separate motor may also be used to operate a compressor which provides the forced air for bulb cooling.

SUMMARY OF THE INVENTION

In accordance with the present invention, a single rotary motor is used to rotate the bulb and to provide rotary motion to the blower for magnetron cooling and/or to provide rotary motion to a forced gas cooling means for bulb cooling. In accordance with a variation, the magnetron may be liquid cooled, in which case, the rotary motor would provide rotary motion to a pump for flowing cooling liquid over the magnetron.

The present invention affords many advantages including reduced cost and parts count, reduced wiring complexity, and increased reliability because motors are the weak link in a microwave lamp and tend to fail. By combining two or more motors into one, a higher quality design is provided which has less risk of failure.

Another advantage is that the volume of the lamp is reduced, and it is therefore more compact. This is particularly important for microwave lamps for providing visible light, since such illuminators may be retrofitted into existing fixtures. Thus, the invention is particularly applicable to visible illuminators including those using the sulfur and selenium based fills such as disclosed in U.S. Pat. No. 5,404,076. However, the invention is broadly applicable to all types of microwave lamps regardless of spectral output.

The blowers which are used in the microwave lamps of the prior art for providing forced air cooling of the magnetron are of standard design and include an impeller or blower wheel which is surrounded by a housing for containing the air and emitting it in a specific direction. In accordance with a further aspect of the present invention, a blower is provided which consists only of an impeller, without the usual housing. This represents a significant cost and space saving, while providing adequate cooling of the magnetron.

In accordance with a still further aspect of the invention, the motor, bulb stem and bulb, are provided as an integral unit. Both the bulb and motor are designed to provide about the same long lifetime. However, if either should fail, it is desirable to replace both at the same time, which is easily accomplished if both are an integral unit. In accordance with a further aspect, the bulb, bulb stem, motor, and blower are provided as an integral unit, since blowers get dirty over time and would bear replacement at about the same time as the bulb and/or motor.

The invention will be better appreciated by referring to the following figures, wherein:

BRIEF DESCRIPTION OF PREFERRED EMBODIMENTS

Figure 1:
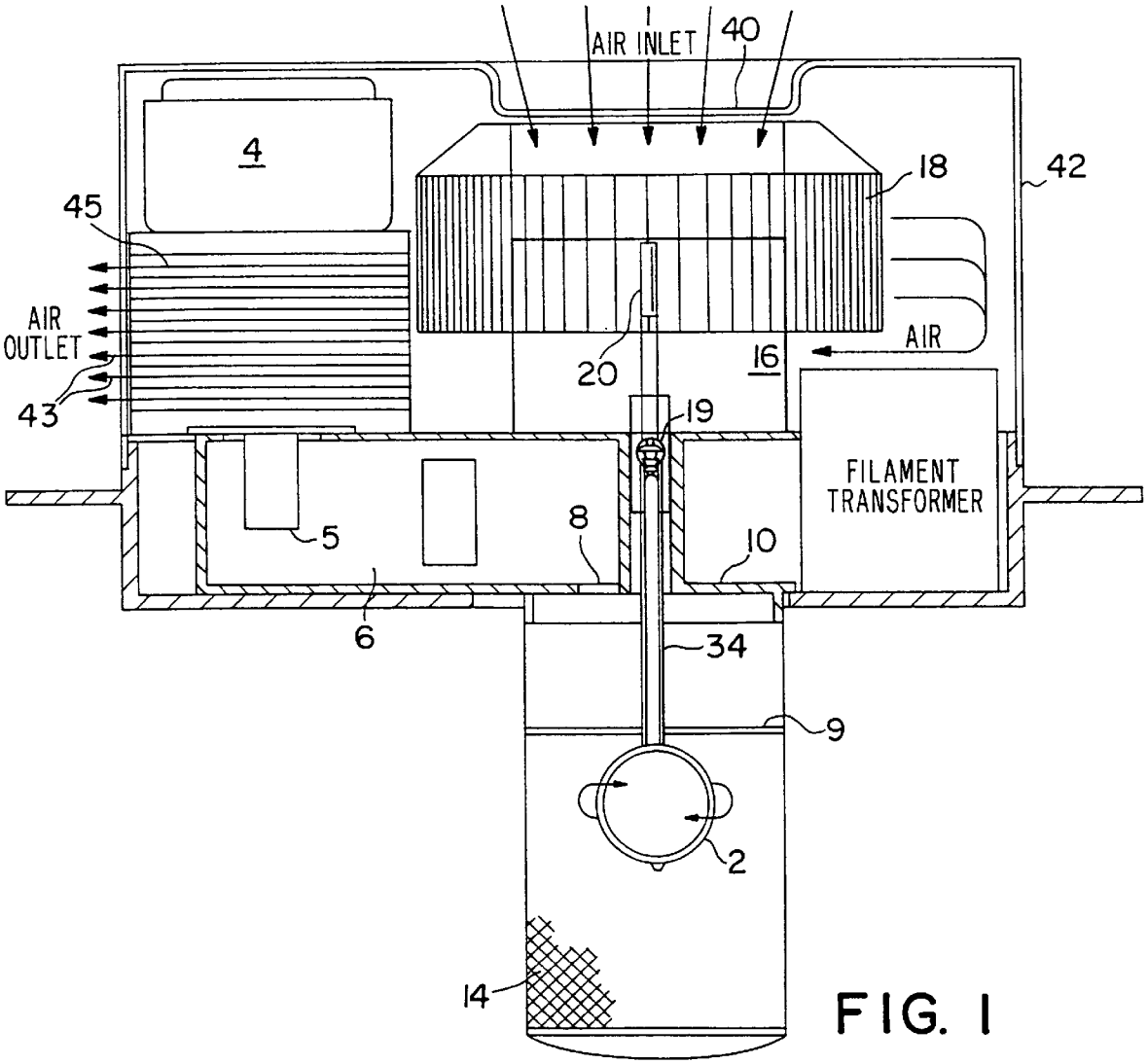
FIG. 1 shows an embodiment of the present invention.

Referring to FIG. 1, an electrodeless lamp utilizing bulb 2 is shown. Magnetron 4 having antenna 5 provides microwave power to rectangular waveguide 6, which couples the power to the fill in bulb 2 via coupling slot 8. The bulb as well as dielectric mirror 9 are located in a microwave cavity comprised of base 10, and cylindrical mesh 14, which is opaque to microwave radiation but mostly transparent to visible light. An impeller or blower wheel 18 is included for providing cooling air for the magnetron.

In accordance with an aspect of the invention, rotary motor 16 is provided for rotating both the bulb and the impeller. The motor has co-linear shaft portions 19 and 20 extending in opposite directions. The lower shaft portion 19 is coupled to stem 34 attached to bulb 2, for rotating the bulb, while the upper shaft portion is coupled to the impeller. Any mechanical coupling mode known to those skilled in the art may be used for coupling the motor shaft to the bulb stem and impeller. In the embodiment shown in FIG. 2, sleeve 32 is epoxied to the bulb stem. The sleeve has tinaman nut 28 therein and the threaded motor shaft portion is secured in the nut. Element 38 of the motor rotates with the upper shaft portion 20 which in turn rotates element 39. Element 53 is glued to both element 39 and to the impeller 41, whereby the impeller is rotated.

Referring to FIG. 1, in the operation of the impeller, air enters housing opening 40 and flows into the impeller, the vanes of which are rotating. This accelerates the air and pressurizes interior of the lamp housing 42. The pressurized air flows over the magnetron fins 45 and exits the housing through holes corresponding with the location of arrows 43.

Thus, it is seen that a compact structure is provided which uses a single motor for both rotating the bulb and the impeller. As mentioned above, such a structure has numerous advantages over the prior art configuration which used two motors, including lower cost, fewer parts, lower volume, and increased reliability.

Figure 3:
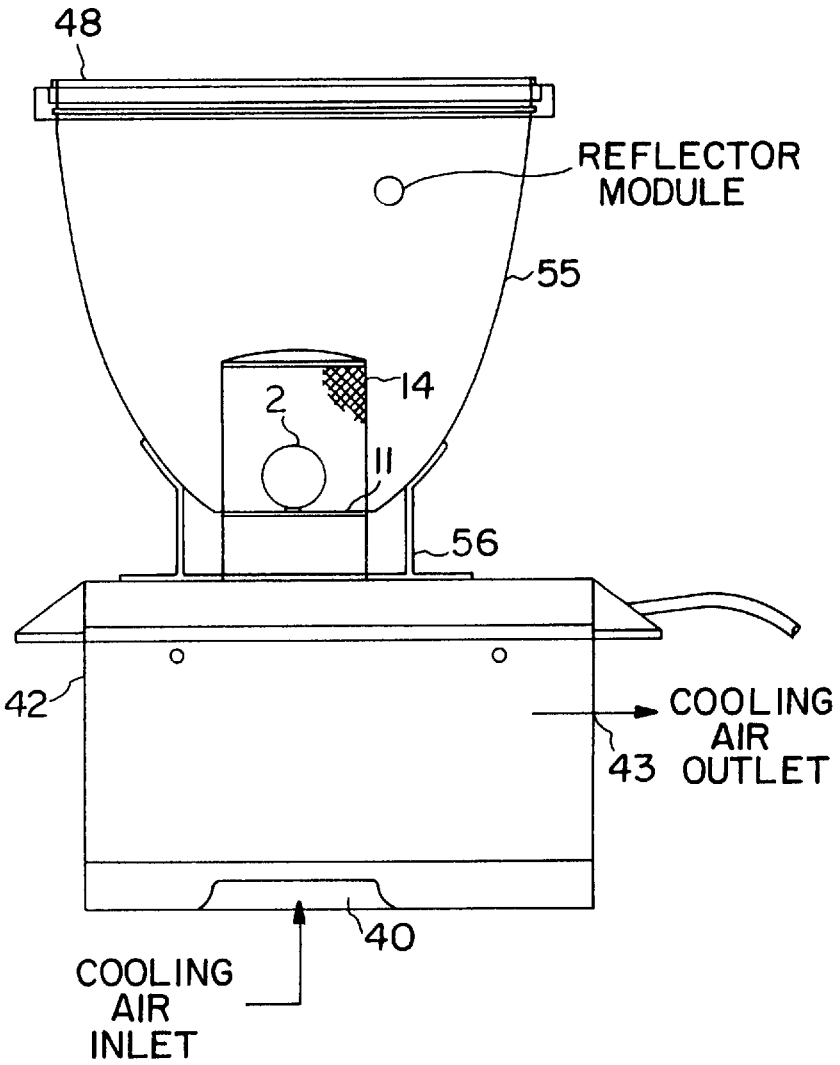
FIG. 3 shows an exterior view of the lamp and reflector.

Referring to FIG. 3, an exterior view of a lamp incorporating the invention is shown. Housing 42 encloses the magnetron, blower, and associated electronics. Bulb 2 is disposed in mesh 14 adjacent dielectric mirror 11, while external reflector 55 is secured to the housing by bracket 56. A cover glass 48 is secured with a holder across the mouth of the reflector. Cooling air flows into opening 40 in the housing and flows out at the location of arrow 43 after cooling the magnetron.

Figure 2:
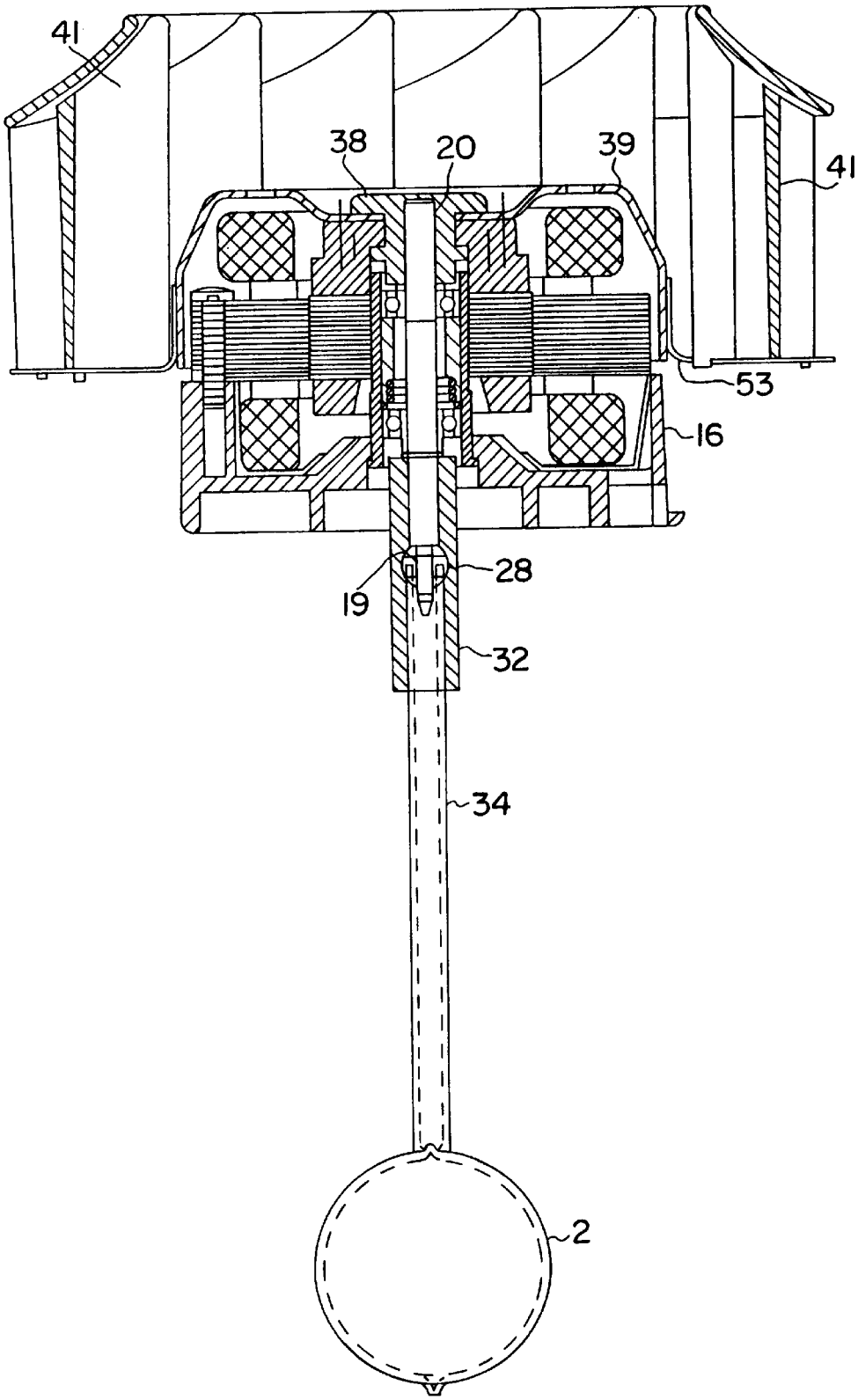
FIG. 2 is a detailed view of the motor and shaft coupling, which impartially in cross-section.

The embodiment shown in FIGS. 1 and 2 employs air pulled in from the environment to cool the magnetron, which is then emitted back into the environment. In many cases, the circulation of this air is a problem due to the presence of dust, moisture, foreign particles, bugs, etc. Thus, a sealed system is desirable. One way to achieve this is to cool the magnetron with liquid coolant, such as water, and to eject the heat through cooling fins which are located outside the unit.

Figure 4:
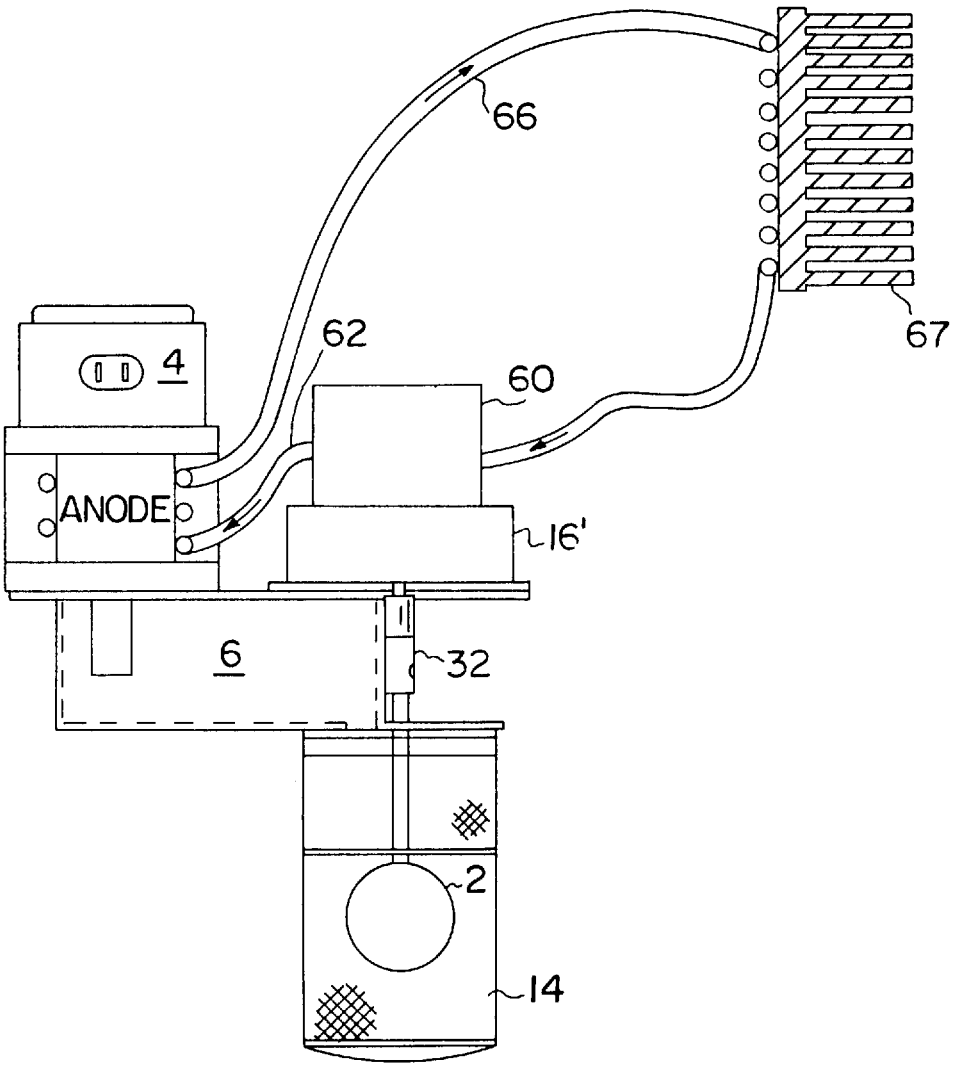
FIG. 4 to 6 show further embodiments of the invention.

An embodiment using liquid cooling is shown in FIG. 4. Motor 16' has a lower shaft portion which is coupled to the bulb stem as in the previous embodiment, but in this case the upper shaft portion drives a rotary pump 60. Pump 60 pumps cooling liquid to magnetron 4 via conduit 62, which after cooling the magnetron is returned via conduit 66 to heat exchanger 67 which is located outside of the lamp housing. Liquid is cooled in the heat exchanger by outside air, after which it is recirculated to the magnetron.

Water cooled magnetrons are available, particularly at higher powers. The advantages are lower magnetron anode temperatures and the elimination of the noise, dust and power required to push large volumes of air over the fins in a magnetron. Various liquid coolants may be used, e.g. a water/alcohol or water/glycol mixture so the lamp can operate in an outdoor environment.

Pumps which would be suitable are available. For example, seal-less magnetically coupled pumps are common, and small diameter high speed pumps are well known.

Figure 5:
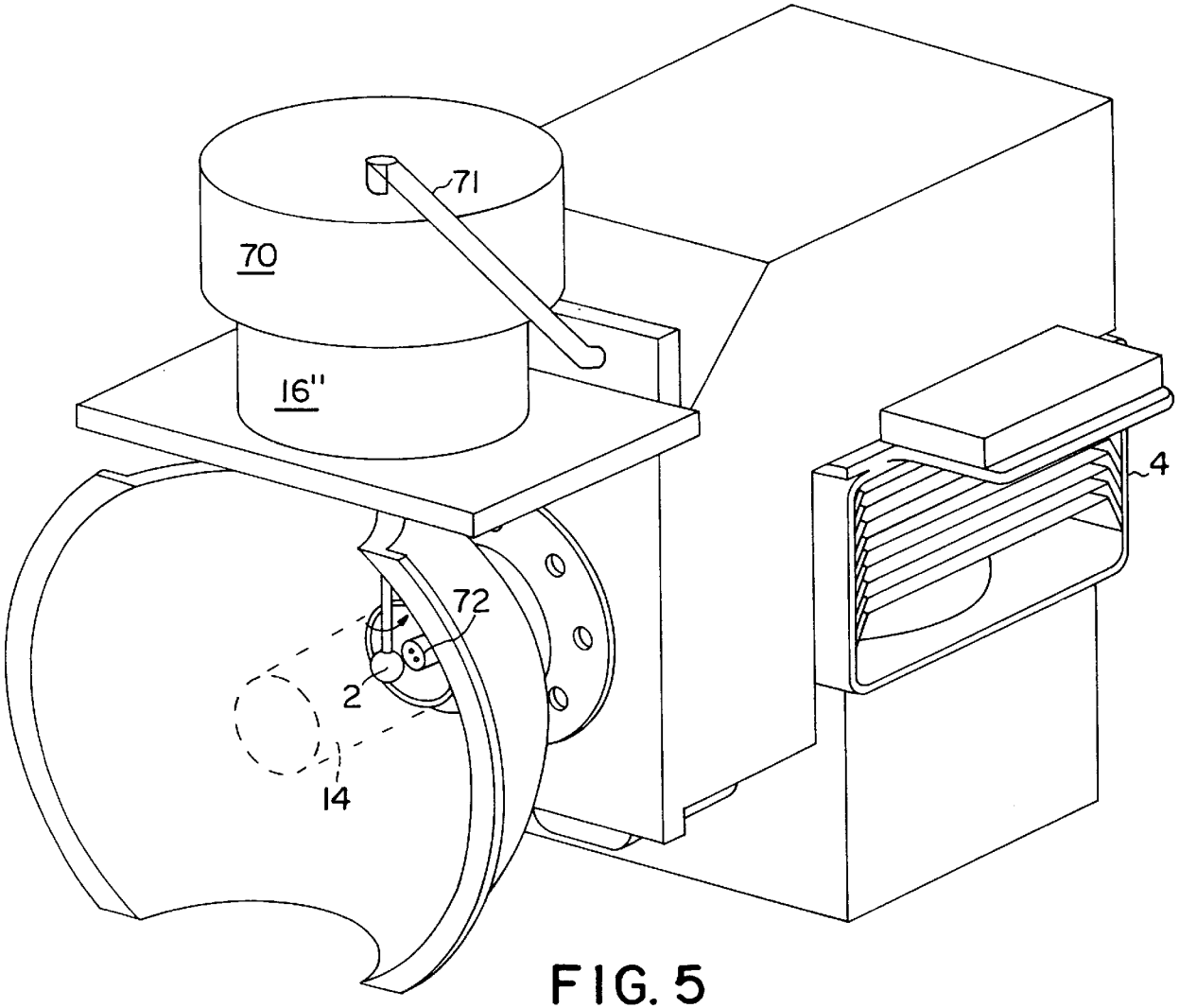

A further embodiment of the invention is shown in FIG. 5. As mentioned above, it is necessary to apply forced air cooling to the bulbs of high power density electrodeless lamps. In FIG. 5, rotary motor 16" is provided which rotates the bulb 2 and also drives a forced gas cooling means such as a rotary high speed compressor 70, for example, a scroll compressor.

Such a compressor can achieve pressures including those from about 0.5 psi to several psi. The pressurized air is fed to conduit 71 and through holes in nozzle 72, which are directed at the bulb. Small projection lamps need to be rotated at high speeds to achieve discharge stability and high efficiency and to eliminate visual "wobble". These are independent effects which may come into play at different speeds; however, inasmuch as they may all be brought in at high enough speed, the arrangement of the invention is appealing where small rotary compressors need to be operated at speeds substantially exceeding synchronous motor speeds. Suitable scroll compressors are known, and examples are described in U.S. Pat. Nos. 3,924,977 and 4,199,308, which are incorporated herein by reference.

Figure 6:
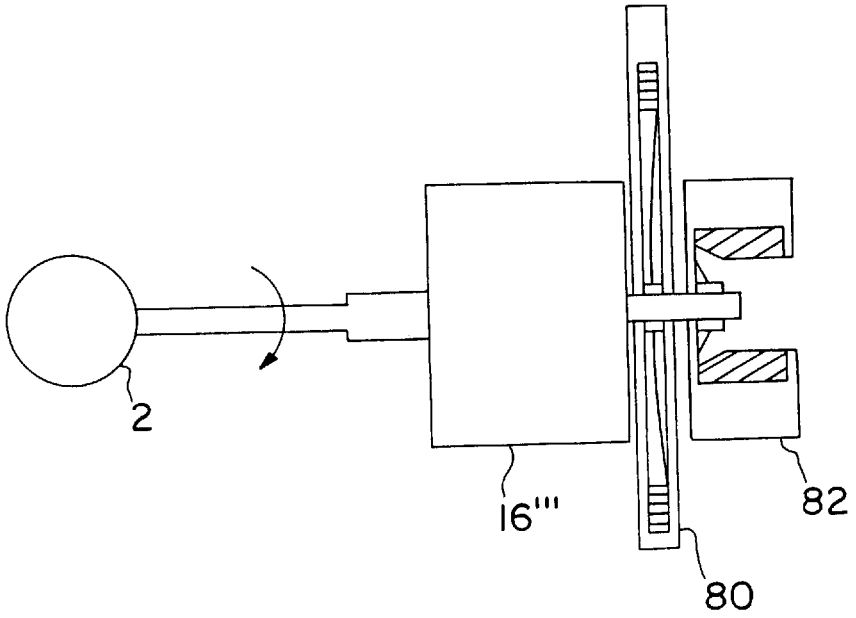

A further embodiment is shown in FIG. 6. In this arrangement, the motor 16'" rotates the bulb with one shaft portion and simultaneously rotates blower means with the other shaft portion for cooling both the magnetron and the bulb. Blower wheel 80 is present for providing high pressure air for cooling the bulb, while low pressure blower wheel 82 of smaller diameter provides air for cooling the magnetron.

In the implementation of the invention shown in FIG. 1, rotation speed of the impeller is selected so as to move sufficient air through the magnetron to keep its anode temperature below the manufacture's specification. The rotation speed of the bulb should be high enough so that imperfections in the bulb's surface or "wobble" of the bulb envelope not cause noticeable spatial modulation of the light as perceived by a human observer. To achieve this we have selected 2700 rpm as the minimum rotation speed. The speed should also be ample to stabilize the sulfur discharge during starting and running conditions. The maximum speed is such that the bulb will not deviate substantially from its axis of rotation due to centrifugal forces. For a given bulb diameter, mass, support stem length and strength there is a speed of rotation which will impart a noticeable deviation from the rotational axis. This should be avoided to prevent possible support stem breakage as well as smearing of the optical footprint as the bulb envelope begins to oscillate about its axis. For the bulb shown in the preferred embodiment (35 mm OD), this speed is about 3450 rpm at 60 Hz.

Figure 7:
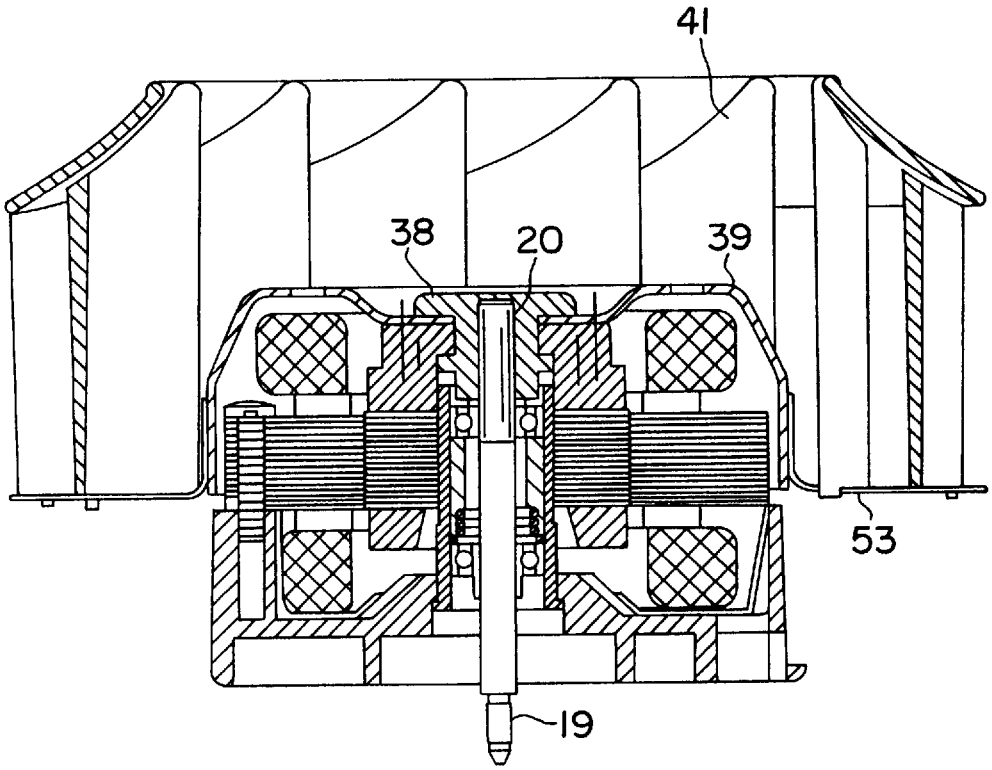
FIG. 7 is a close-up of the motor and impeller.

The motor selected in the preferred embodiment is the Comair Rotron "Diplomat", #DAF77BX. It is 200 VAC, 50/60 Hz extended shaft, 3000 rpm nominal speed. The impeller is 5.29" diameter. A detailed view of the motor/blower is shown in FIG. 7.

In accordance with a further aspect of the invention, as is depicted in FIGS. 1 and 2, the blower used for cooling the magnetron consists only of an impeller. As is well known, a blower typically includes a housing surrounding the impeller for containing and the air and emitting it in a specific direction. However, it has been discovered that by using the impeller alone, substantial cost and space savings in the present application for an electrodeless lamp can be realized. The impeller accelerates the air inputted to it with rotating blades 72. This pressurizes the lamp housing, which causes adequate cooling air to flow over the magnetron. Thus, a major practical advantage is gained.

Figure 8:
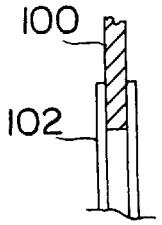
FIG. 8 shows a motor shaft and bulb stem which are integrally connected.

In accordance with a further aspect of the invention, the bulb and motor are manufactured as an integral unit. It is anticipated that with certain fills, e.g., sulfur, the bulb will last for scores of thousands of hours, as should the motor. If, however, either fails, it would be desirable to replace both at the same time. Thus, the bulb stem can be cemented to the motor shaft, as by one or the other being made hollow and the other member being inserted therein and cemented. For example, see FIG. 8 in which motor shaft 100 is glued in hollow stem 102. Then, the entire integral unit is replaced upon failure, obviating replacement of individual parts and necessitating the stocking of only one part. In similar fashion, the blower wheel can be made integral with the bulb/motor, and the whole unit replaced upon failure. This would be advantageous since blower wheels get very dusty and lose efficiency over years of use.

While illustrative embodiments of the invention have been disclosed, variations will certainly occur to those skilled in the art. For example, while motor shaft portions extending in opposite directions are used in the embodiments depicted herein, other designs are possible where the rotation of more than one element is accomplished with a single shaft portions. Additionally, different types of forced gas cooling means may be rotated with the same rotary motor. It should therefore be noted that the disclosed invention should be limited only by the claims appended hereto and equivalents thereof.

We claim:

1. A microwave powered electrodeless lamp comprising, a bulb containing a discharge forming fill which is supported by a bulb stem for rotative motion about an axis of rotation, microwave power generating means for providing microwave power which is coupled to the fill in said bulb, rotary blower means-primarily for cooling said microwave power generating means, said rotary blower means having an axis of rotation which is substantially coincident with the axis of rotation of said bulb, and a rotary motor for imparting rotative motion to both said bulb and said blower means about said substantially coincident axes of rotation.

2. The lamp of claim 1 wherein said microwave power generating means and said rotary blower means are located in a common housing which is pressurized by air provided by said blower means.

3. The lamp of claim 2 wherein said blower means is a unit which comprises an impeller without a surrounding housing.

4. The lamp of claim 1 wherein said rotary motor has first and second shaft portions which are substantially co-linear but extend in opposite directions, said first shaft portion being coupled to said bulb stem and said second shaft portion being coupled to said rotary blower means.

5. The lamp of claim 4 wherein said first shaft portion of said rotary motor and said bulb stem are cemented to each other, thus forming an integral unit.

6. The lamp of claim 5 wherein said second shaft portion of said rotary motor is cemented to said blower means.

7. A microwave powered electrodeless lamp comprising, a bulb containing a discharge forming fill which is supported by a bulb stem for rotative motion about an axis of rotation, microwave power generating means for providing microwave power which is coupled to the fill in said bulb, rotary pump means for providing cooling liquid to said microwave power generating means, said pump means having an axis of rotation which is substantially coincident with the axis of rotation of said bulb, and a rotary motor for imparting rotative motion to both said bulb and said pump means about said substantially coincident axes of rotation.

8. The lamp of claim 7 wherein said rotary motor has first and second shaft portions which are substantially co-linear but extend in opposite directions, said first shaft portion being coupled to said bulb stem and said second shaft portion being coupled to said rotary pump means.

9. A microwave powered electrodeless lamp comprising, a bulb containing a discharge forming fill which is supported by a bulb stem for rotative motion about an axis of rotation, microwave power generating means for providing microwave power which is coupled to the fill in said bulb, means for providing cooling gas directed at said bulb which includes a rotary compressor as the source of said cooling gas, said rotary compressor having an axis of rotation which is substantially coincident with the axis of rotation of said bulb, and a rotary motor for imparting rotative motion to both said bulb and said compressor about said substantially coincident axes of rotation.

10. The lamp of claim 9 wherein said rotary motor has first and second shaft portions which are substantially co-linear but extend in opposite directions, said first shaft portion being coupled to said bulb stem and said second shaft portion being coupled to said compressor means.

11. A microwave powered electrodeless lamp comprising, a bulb containing a discharge forming fill which is supported by a bulb stem for rotative motion about an axis of rotation, microwave power generating means for providing microwave power which is coupled to the fill in said bulb, first rotary blower means for providing cooling air to said microwave power generating means, said rotary blower means having an axis of rotation which is substantially coincident with the axis of rotation of said bulb, second rotary blower means for providing cooling air to said bulb, said second rotary blower means having an axis of rotation which is substantially coincident with the axis of rotation of said bulb, and a rotary motor for imparting rotative motion to all of said bulb, said first rotary blower means and said second rotary blower means about said substantially coincident axes of rotation.

12. A microwave powered electrodeless discharge lamp, comprising:

a bulb containing a discharge forming fill which is supported by a bulb stem, the bulb stem defining a first axis of rotation for the bulb;

a source of microwave power;

a coupling structure configured to couple the microwave power to the fill in the bulb;

a blower configured to provide cooling air primarily to the source of microwave power, the blower having a second axis of rotation for the blower; and a single motor for rotating both the bulb about the first axis of rotation and the blower about the second axis of rotation.

13. The discharge lamp as recited in claim 12, wherein the source of microwave power comprises a magnetron and wherein the coupling structure comprises a waveguide coupled to a microwave cavity, wherein the bulb is disposed the microwave cavity, the magnetron provides the microwave power to the waveguide, and the microwave power is coupled to the fill in the bulb via a coupling slot in the waveguide.

14. The discharge lamp as recited in claim 12, wherein the first axis of rotation and the second axis of rotation are substantially coincident.

15. The discharge lamp as recited in claim 14, wherein the source of microwave power and the blower are located in a common housing which is pressurized by the cooling air provided by the blower.

16. The discharge lamp as recited in claim 15, wherein the blower comprises an impeller without a surrounding housing.

17. The discharge lamp as recited in claim 12, wherein the motor comprises first and second shaft portions which are substantially co-linear but extend in opposite directions, and wherein the first shaft portion is coupled to the bulb stem and the second shaft portion is coupled to the blower.

18. The discharge lamp as recited in claim 17, wherein the first shaft portion of the motor and the bulb stem are cemented to each other to form an integral unit.

19. The discharge lamp as recited in claim 18, wherein the second shaft portion of the motor and the blower are cemented to each other.

20. A method of operating a microwave powered electrodeless discharge lamp, the method comprising the steps of:

providing a bulb containing a discharge forming fill;

providing a source of microwave power;

coupling the microwave power from the source of microwave power to the fill in the bulb;

cooling the source of microwave power with air from a blower; and rotating both the bulb and the blower with a single motor.

21. The method as recited in claim 20, wherein the step of rotating comprises rotating both the bulb and the blower about a substantially coincident axis of rotation.

* * * * *